US006758474B1

(12) United States Patent
Monroe, Jr.

(10) Patent No.: US 6,758,474 B1
(45) Date of Patent: Jul. 6, 2004

(54) MARBLE-SEQUESTERING SKILL GAME

(76) Inventor: Donald Monroe, Jr., 3201 Rita La. NW., Huntsville, AL (US) 35810-3047

( * ) Notice: Subject to any disclaimer, the term of this patent is extended or adjusted under 35 U.S.C. 154(b) by 0 days.

(21) Appl. No.: 10/242,307

(22) Filed: Sep. 12, 2002

Related U.S. Application Data

(60) Provisional application No. 60/318,860, filed on Sep. 13, 2001.

(51) Int. Cl.[7] ..... A63F 9/08

(52) U.S. Cl. ..... 273/153 S; 273/118 R; 273/109

(58) Field of Search ..... 273/153 R, 153 S, 273/113, 108, 109, 118 R

(56) References Cited

U.S. PATENT DOCUMENTS 524,703 A * 8/1894 Carter ..... 273/153 S
772,281 A 10/1904 Jurado
2,515,346 A * 7/1950 Jackson ..... 273/113
4,316,613 A 2/1982 Harris
4,385,766 A 5/1983 Grow
4,413,823 A * 11/1983 Breslow ..... 273/153 S
4,512,579 A 4/1985 Clipper
4,877,248 A * 10/1989 Farraj ..... 273/153 S
4,979,748 A * 12/1990 Danielak et al. ..... 273/241
5,494,292 A 2/1996 Mileti
5,803,452 A 9/1998 DeCristoforo
6,010,130 A 1/2000 Schreiber

* cited by examiner

*Primary Examiner*—Raleigh W. Chiu
(74) *Attorney, Agent, or Firm*—Lanier Ford Shaver & Payne P.C.

(57) ABSTRACT

A marble sequestering skill game having transparent hollow vertical tube members attached to a base and to a nontransparent hollow tubular top member, and being filled with marbles, each marble having an identifying feature. The marbles can be moved from one vertical tube member to another through the tubular top member so that marbles can be sequestered by the identifying features into a selected vertical tube member by tilting and rotating the base.

5 Claims, 2 Drawing Sheets

MARBLE-SEQUESTERING SKILL GAME

This application claims the benefit of U.S. Provisional Application No. 60/318,860, filed Sep. 13, 2001, the disclosure of which is hereby incorporated by reference

BACKGROUND OF THE INVENTION

1. Field of the Invention

The present invention is related to the field of marble games, more particularly to a marble sequestering game of skill wherein the marbles are held within a container.

2. Technical Background

Numerous marble games are known in the art. Many of these are board games, maze games, or puzzles. Some marble games are rotatable and tiltable and involve skill and chance. Marbles can be unsafe for young children and infants unless they are permanently held within a container. At present there is no known marble game that provides the attributes of a puzzle, skill, and chance game wherein the game is rotatable and tiltable, the marbles are held permanently in a container, and the game forms an attractive design when completed. The present invention provides a marble sequestering game with these attributes.

SUMMARY OF THE INVENTION

The present invention has a plurality of cylindrical tube members that are transparent. They are connected to a top member that is cylindrical and hollow and communicates with the hollow tube members. The hollow tube members are attached to a rectangular base. Each tube member contains a plurality of marbles, a different color for each tube. When the device is inverted, the marbles fall into the top member and are mixed and contained therein. Since the top member is not transparent, it is not possible to visualize the marbles when they are in the top member, except at the opening of a tube member. When the device is rotated so that the top member is on top, in the upright position, the marbles contained within the top member begin dropping into the tube members. By rotating and tilting the device, specific colored marbles can be made to fall into the tube members. The object of the game is to sequester the marbles by color so that each vertical transparent cylinder contains marbles of only one color. However, the user may also choose to define a fixed combination of colors for each cylinder. The marbles are permanently enclosed within the cavities of the tube members and the top member. When the game is complete, the game further provides a decorative object.

An advantage of the present invention is that it provides a challenging game of skill using colored marbles.

Another advantage of the present invention is that it provides an attractive decorative object when the game is complete.

Another advantage of the present invention is that it provides a game that is safe for children.

Another advantage of the present invention is that it may be played by a single individual and does not require other participants.

BRIEF DESCRIPTION OF THE DRAWING FIGURES

DETAILED DESCRIPTION OF THE PREFERRED EMBODIMENTS

While the following description details the preferred embodiments of the present invention, it is to be understood that the invention is not limited in its application to the details of construction and arrangement of the parts illustrated in the accompanying drawings, since the invention is capable of other embodiments and of being practiced in various ways.

Figure 1:
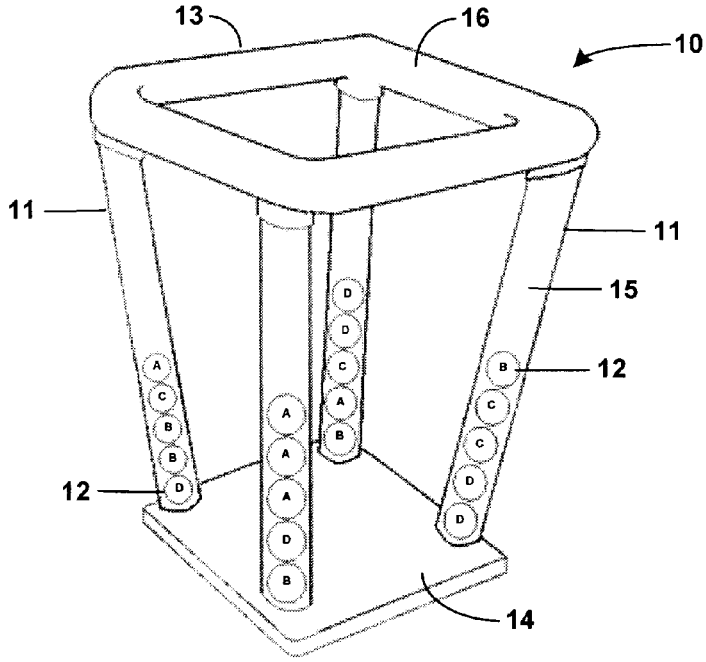
FIG. 1 shows a top perspective view of the marble game of the present invention.

FIG. 1 shows the marble game 10 of the present invention. Game 10 has a plurality of transparent cylindrical tube members 11, preferably four, which are hollow and can contain marbles 12. One end of tube member 11 is attached to a top member 13 which is also tubular as well as hollow and can contain marbles 12. The internal hollow portion 15 of tube members 11 are in communication with the internal hollow portion 16 of top member 13. The opposite ends of tube members 11 are attached to base 14, which closes tube members 11 at this end so that marbles 12 cannot exit tube members 11 at this end. Top member 13 is, preferably, not transparent but may be transparent if desired. Tube members 11 are, preferably, attached permanently and vertically to top member 13 and base 14, however, tube members may be reversibly attached if desired. Although tube members 11 and top member 13 are shown as round or cylindrical, they may assume any shape as desired as long as the marbles 12 can move freely through the internal hollow portions 15 and 16. Both top member 13 and base 14 are shown as square but they can also have as many sides as desired or be round.

Marbles 12 or similar spherical objects are placed in each tube member 11, at least one marble 12 per tube member 11. The marbles 12 have an identifying feature such that one unique marble type is associated with any given tube member 11 the user chooses. In FIG. 1 the marbles 12 are identified with a letter. For example, A is red, B is blue, C is green, and D is yellow. Various colored marbles are in each tube member 11. However, the object of the game is to position marbles 11 of one color in one tube member 11, i.e., one tube member 11 will have all red marbles, another tube member 11 will have all blue, and so on. Alternatively, a user may choose to create a defined pattern of colors in each tube member 11.

Figure 2:
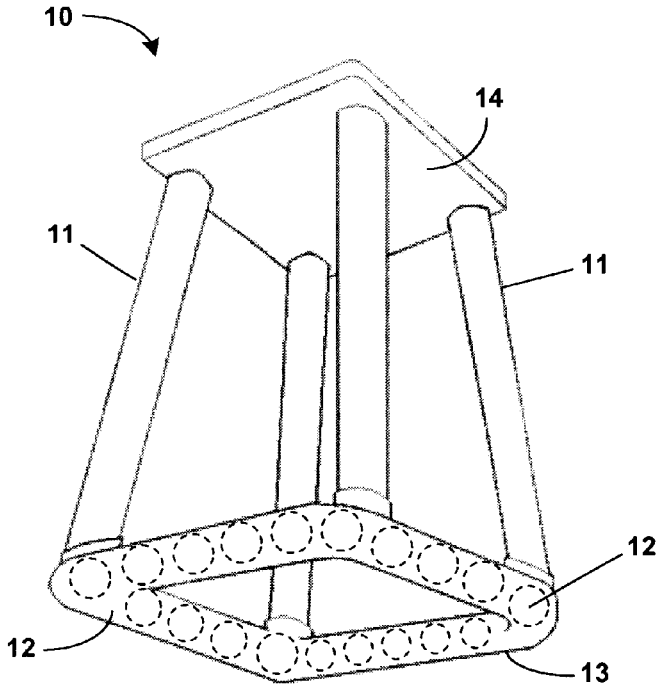
FIG. 2 shows a bottom perspective view of the marble game of the present invention.
Figure 3:
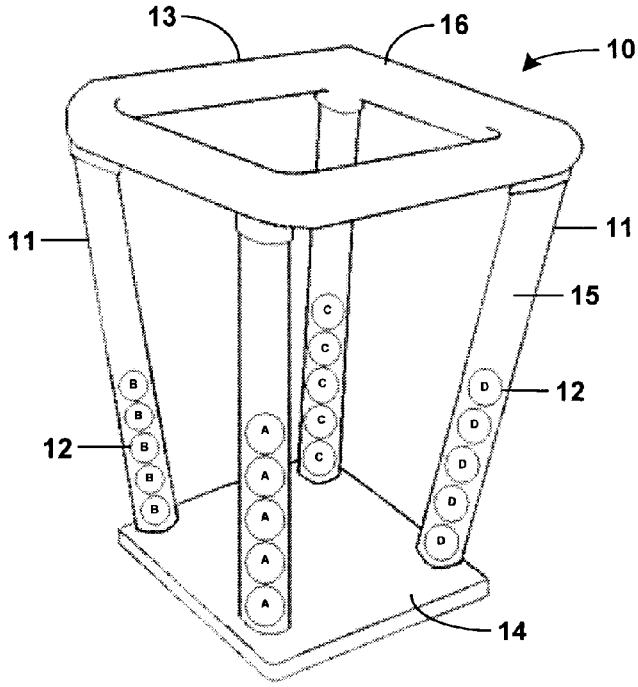
FIG. 3 shows an example of the marbles sorted by color into each leg of the marble game, thereby completing the game.
Figure 4:
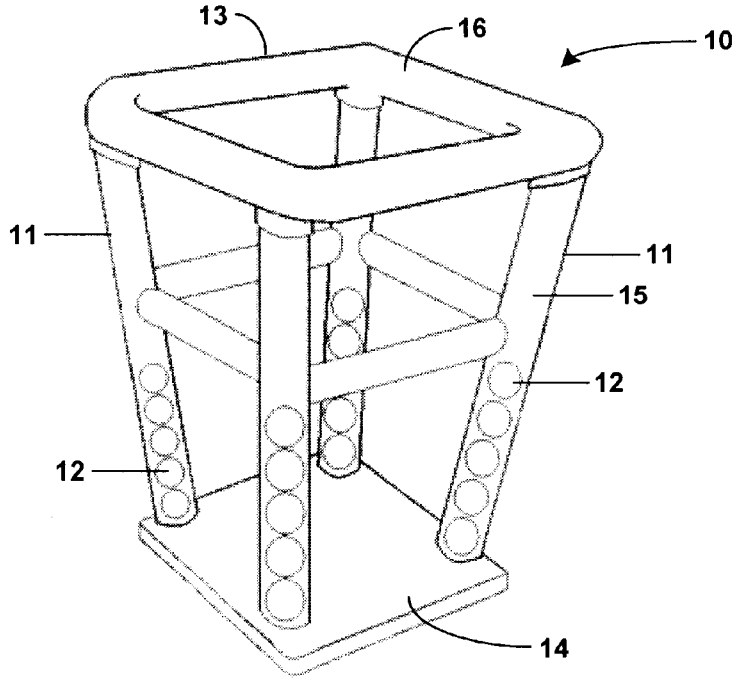
FIG. 4 shows an alternative embodiment of the present invention including a plurality of intermediate horizontal tubular members connecting the hollow vertical tubes at a point between the base and the tubular top member.

By tipping or rotating game 10 upside down, as shown in FIG. 2, all the marbles 12 will fall into top member 13. Game 10 can then be tipped and rotated by a user as desired to move marbles 12 around the internal hollow portion 16 of top member 13. The marbles can be visualized in top member 13 at the openings of tube members 11 into top member 13. Game 10 can also be tipped and rotated so that marbles 12 fall from top member 13 into a tube member 11. As noted above, the object of the game is to sequester all the marbles 12 of a given color or other unique feature into a single tube member 11, and to repeat this sequestering for all tube members 11, so that each tube member 11 contains all the marbles of a given color or feature, as shown in FIG. 3. This is accomplished by tipping and rotating game 10 to direct a marble 12 of a specific color to a specific tube member 11.

An example solution to the game whereby each tube member has, for example, five marbles of a given color, as shown in FIG. 3, is as follows. To start the game, invert the game so that all marbles are contained in top member 13. Rotate the game so that a marble color of choice, for example A, is located at the opening of a first tube member of choice. Return the game to its upright position so that the marble of choice falls to the bottom of the tube member of choice. Then rotate the game to remove all the other marbles from the tube of choice above the A marble, unless they are A marbles, and deposit all of them in the remaining three non-choice tube members. Then locate the next uppermost A marble in a non-choice tube member and remove all the other marbles above it into the other two remaining non-choice tube members. Then rotate the game so that the A marble in the non-choice tube member enters the top member by itself, and rotate the top member until the A marble in the top member is at the opening of the tube member of choice. Then turn the game to the upright position so that the A marble in the top member falls into the tube member of choice. If any other non-A marbles follow into the tube member of choice, return them to the top member and place them in the non-choice tube members. Repeat this process for all the A marbles. Then select a second tube member of choice and repeat the process so that all marbles of a given color, other than A, for example B, are in the second tube member of choice. Repeat the process for a third tube member of choice selecting, for example, color C. The fourth tube member will then have the remaining D colored marbles.

The foregoing description has been limited to specific embodiments of this invention. It will be apparent, however, that variations and modifications may be made by those skilled in the art to the disclosed embodiments of the invention, with the attainment of some or all of its advantages and without departing from the spirit and scope of the present invention. For example, the game 10 of the present invention is constructed of any suitable plastic but may also be made of glass. Game 10 may also be made in any height or width as desired. Game 10 may also have a center tube member and top portion 13 may have hollow cross members tubes connecting one side of top member 13 with the opposite side. Likewise, tube members 11 may also have hollow cross member tubes interconnecting each tube member 11. In this manner, marbles could be moved from one side of top member 13 to the other without going around top member 13, and marbles could be transferred from one tube member 11 to another without going through top member 13.

It will be understood that various changes in the details, materials, and arrangements of the parts which have been described and illustrated above in order to explain the nature of this invention may be made by those skilled in the art without departing from the principle and scope of the invention.

I claim:

1. A marble-sequestering skill game, comprising:

a) a plurality of transparent hollow vertical tube members arranged in a pyramidal configuration each of which contain marbles, each of said marbles having an identifying feature;

b) a base for attachment of a first end of each vertical tube member; and c) a hollow tubular top member for attachment of an opposite end of each vertical tube member, wherein said marbles can be moved from one vertical tube member to another vertical tube member through said tubular top member so that marbles can be sequestered by said identifying features into a selected vertical tube member by tilting and rotating said base.

2. The marble-sequestering game of claim 1, wherein said identifying feature of each said marbles are one of a predefined set of colors.

3. The marble-sequestering game of claim 2, further comprising a horizontal tubular member connecting two of said plurality of transparent hollow vertical tube members between said base and said tubular top member.

4. A marble-sequestering game, comprising:

a) a plurality of hollow vertical tube members arranged in a pyramidal configuration;

b) a base for attachment of a first end of each of said plurality of vertical tube members;

c) a tubular horizontal member forming a closed horizontal loop, an opposing end of each of said vertical tube members attached to said closed horizontal loop;

d) wherein a plurality of marbles each having an identifying feature can be moved through said closed horizontal loop for sequestration into said plurality of vertical tube members by identifying feature; and e) a plurality of intermediate horizontal tubular members connecting two of said plurality of hollow vertical tube members.

5. The marble-sequestering game of claim 4, wherein said identifying feature of each said marbles are one of a predefined set of colors.

* * * * *